US007004890B2

(12) United States Patent
Webb et al.

(10) Patent No.: US 7,004,890 B2
(45) Date of Patent: Feb. 28, 2006

(54) LEG PRESS WEIGHT TRAINING MACHINE

(75) Inventors: Gregory M. Webb, Independence, VA (US); Mickey J. Hall, Sparta, NC (US)

(73) Assignee: Nautilus Human Performance Systems, Inc., Independence, VA (US)

( * ) Notice: Subject to any disclaimer, the term of this patent is extended or adjusted under 35 U.S.C. 154(b) by 461 days.

(21) Appl. No.: 10/192,330

(22) Filed: Jul. 10, 2002

(65) Prior Publication Data

US 2004/0009857 A1 Jan. 15, 2004

(51) Int. Cl.
*A63B 21/062* (2006.01)
*A63B 21/00* (2006.01)

(52) U.S. Cl. ..... 482/100; 482/98; 482/135

(58) Field of Classification Search ..... 482/97–103, 482/133–138, 142
See application file for complete search history.

(56) References Cited

U.S. PATENT DOCUMENTS

| | | | | |
|---|---|---|---|---|
| 5,106,081 | A | 4/1992 | Webb | |
| 5,366,432 | A * | 11/1994 | Habing et al. | 482/138 |
| 5,484,365 | A * | 1/1996 | Jones et al. | 482/97 |
| 5,549,533 | A * | 8/1996 | Olson et al. | 482/137 |
| 5,616,107 | A * | 4/1997 | Simonson | 482/97 |
| 6,220,993 | B1 * | 4/2001 | Sencil | 482/97 |
| 6,287,241 | B1 | 9/2001 | Ellis | |
| 6,296,596 | B1 * | 10/2001 | Alessandri et al. | 482/100 |

OTHER PUBLICATIONS

Nautilus catalogue "So Much More Than Just Iron & Steel" *Leg Press & Super Leg Press* (2000).
Nautilus catalogue "NITRO™ Compact Strength Training Systems" *Leg Press* p. 6. (1999).
Tuff Stuff *CT-760 45° Leg Press* (Jun. 2000).
Tuff Stuff *CT 770 Horizontal Leg Press* (Jun. 2000).
Tuff Stuff *CT-230 Leg Press* (Jun. 2000).
Quantum *Angled Leg Press/Calf Raise* [*CS-596*] 1999.
Paramount *Leg Press PL-28000* p. 15 (Jun. 2000).
Paramount *Total Leg PFW-8800* p. 4 (Jun. 2000).
HOIST, *Leg Press* (Jan. 1995).
Magnum Fitness Systems; *Seated Leg Press B203*; p. 26. (Jun. 2000).
Cybex *Leg Press* Product No. 5643 (Jan. 2000).
Cybex Catalog; (2001).
Life Fitness; *Horizontal Leg Press and Seated Leg Press*, (Jun. 2000).
HOIST; *CL 2403 Seated Leg Press Features*; (Apr. 2000).

* cited by examiner

*Primary Examiner*—Jerome W. Donnelly
*Assistant Examiner*—Fenn C. Mathew
(74) *Attorney, Agent, or Firm*—Myers Bigel Sibley & Sajovec

(57) ABSTRACT

A leg press exercise machine comprises: a frame; a seat unit attached to the frame; a press mechanism attached to the frame, the press mechanism including a foot panel and at least one swing link pivotally interconnected with the frame; a resistance-imparting unit operatively connected with the press mechanism; and a resistance coupling mechanism attached to the press mechanism and the resistance-imparting unit. The press mechanism is configured such that the foot panel is movable along a generally longitudinal stroke path between a retracted position and a fully extended position. The resistance-imparting unit provides resistance to the foot panel as it moves from the retracted position to the fully extended position. The resistance coupling mechanism includes a drawing link pivotally interconnected with the swing link and a control link pivotally interconnected with the drawing link and the press mechanism. The control link is further attached to the resistance-imparting unit.

18 Claims, 5 Drawing Sheets

LEG PRESS WEIGHT TRAINING MACHINE

FIELD OF THE INVENTION

The present invention relates generally to exercise equipment, and relates more particularly to weight training equipment.

BACKGROUND OF THE INVENTION

Exercise devices, and in particular weight training machines, typically include a mechanical member that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One popular exercise movement is the leg press, which involves straightening the legs from a position in which they are bent at approximately a ninety degree angle at the knees and in which the exerciser's thighs are bent so that the exerciser's knees are drawn somewhat near the chest. Generally, the leg press movement exercises the quadriceps, gluteals, and hamstrings of the exerciser.

The leg press movement can be carried with different types of apparatus. For example, some machines are configured such that the exerciser lays on his back with the thighs generally upright and applies a generally horizontal force against a foot panel with the heels. Such machines can have a "sled" configuration, in which a platform supporting the exerciser slides rearwardly as he pushes his feet against a foot panel, or a configuration in which the foot panel moves relative to the frame in response to the exerciser pushing against it. Such a machine is exemplified by the NITRO™ Leg Press, available from Nautilus HPS, Inc., Independence, Va. As another example, machines exist in which the exerciser is in a generally upright or inclined seated position with his back placed against a backrest and applies a generally horizontal force through the heels against a foot panel. These machines can also have a "sled"-type design, in which the seat and backrest slide relative to the frame, or a stationary seat design, in which the foot panel moves relative to the frame. An exemplary machine of this type is the 2ST leg press machine, available from Nautilus HPS, Inc., Independence, Va. (also illustrated in U.S. Pat. No. 5,106,081).

One issue that can arise with leg press machines is the angle at which force is applied to the foot panel. Ideally, this force should be applied parallel to the tibia of the user (i.e., the foot panel is normal to the user's tibia) to reduce shear stress on the knee joint and to increase exercise efficiency. With a sled-type design, typically the foot panel is stationary, so the angle of the tibia to the foot panel varies as the leg straightens. With a typical simple swing arm-type design in which the foot pad moves relative to the frame, the foot panel tends to increase its angle relative to the exerciser's back as the foot panel moves away from the user. Unfortunately, this variation in angle should decrease in order to maintain the desired ninety degree angle with the tibia. One approach to address this problem is illustrated in the Nautilus 2ST leg press machine discussed above, in which a pair of swing arms interconnect with a base and a member connected to the foot pad to decrease the angle of the foot pad in the desired manner.

Another potential issue with leg press machines is the degree of resistance experienced by the user during the exercise stroke. It is well-known in this art that the leverage and mechanical advantage enjoyed by the exerciser during typical weight training vary at different points along the path defined by an exercise movement. In order to increase the efficiency of the exercise, exercise machine designers often design machines so that the resistance experienced by the exerciser varies within the exercise stroke to match the extent of the exerciser's mechanical advantage. The variation in resistance is typically carried out with cams and/or mechanical linkages that couple the exercise movement member and the resistance. In the leg press movement, the exerciser has his least mechanical advantage when his thighs form a ninety degree angle with his lower legs, and has a much greater mechanical advantage as the legs become more completely extended. Consequently, leg press machines are often designed so that the resistance at the end of the press movement is much higher than that at the beginning of the movement. Although the resistance variation for leg press machines has been satisfactorily accomplished with cams (which tend to be more expensive to produce than mechanical linkages), to date the mechanical linkages designed to vary resistance in leg press machines have generally had some shortcomings, particularly for leg press machines that attempt to provide and maintain the ideal ninety degree relationship between the exerciser's tibia and the foot panel.

SUMMARY OF THE INVENTION

A leg press exercise machine of the present invention can provide the desired resistance profile in a swing arm-type design. Such a machine comprises: a frame; a seat unit attached to the frame; a press mechanism pivotally attached to the frame, the press mechanism including a foot panel configured to receive an exerciser's feet during exercise and at least one swing link pivotally interconnected with the frame; a resistance-imparting unit operatively connected with the press mechanism; and a resistance coupling mechanism attached to the press mechanism and to the resistance-imparting unit. The press mechanism is configured such that the foot panel is movable along a generally longitudinal stroke path between a retracted position and a fully extended position. The resistance-imparting unit (preferably a weight stack) provides resistance to the foot panel as it moves from the retracted position to the fully extended position. The resistance coupling mechanism includes a drawing link pivotally interconnected with the at least one swing link and a control link pivotally interconnected with the drawing link and with the press mechanism. The control link is further attached to the resistance-imparting unit. In this configuration, the leg press machine can, through a relatively inexpensive and easily manufactured mechanism, provide a desirable resistance profile.

It is preferred that the press mechanism include both front and rear swing links, each of which is connected to the foot panel through a connecting link, and that the drawing link be pivotally interconnected with the front swing link and to the control link. The control link may also be connected with the connecting link. In this configuration, the leg press machine can maintain the preferred relationship between the tibia and the foot panel of the machine.

DETAILED DESCRIPTION OF THE INVENTION

Figure 1:
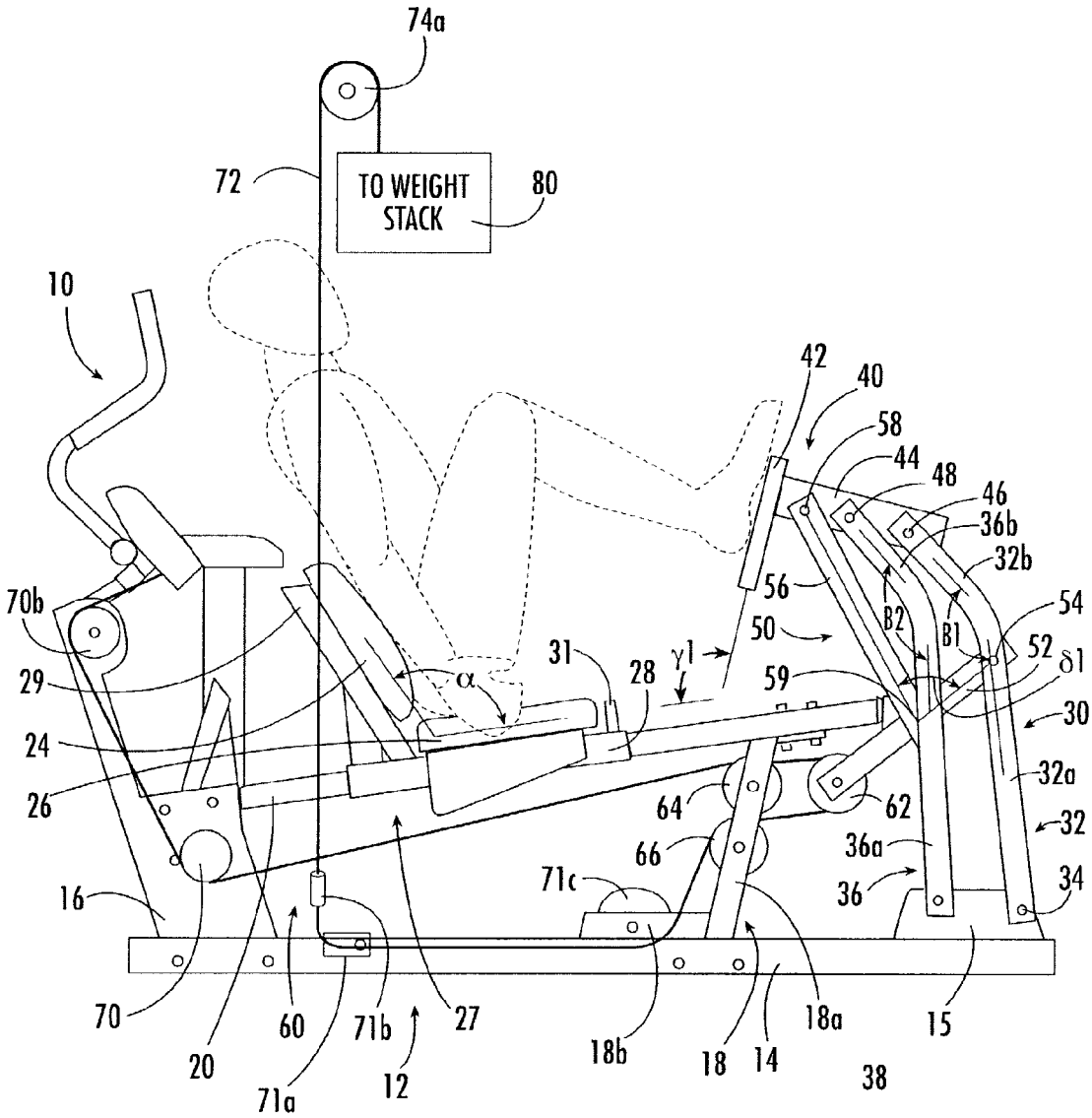
FIG. 1 is a side view of a leg press exercise machine of the present invention with the foot panel in its retracted position, and with the weight stack shown schematically.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the drawings, a leg press machine, designated broadly at 10, is illustrated in FIG. 1. The leg press machine 10 includes a frame 12, a press mechanism 30, a drawing pulley mechanism 50, a pulley train 60, and a weight stack 80. These components are described in greater detail below.

In describing the leg press machine 10, it will be assumed for the purposes of description that the terms "front", "forward", and derivatives thereof refer to the horizontal direction a seated exerciser faces (ie., to the right as shown in FIG. 1). The term "rear" and derivatives thereof refer to the horizontal direction that is opposite the "forward" direction (i.e., to the left as shown in FIG. 1). Together, the "forward" and "rear" directions comprise the "longitudinal" dimension of the machine 10. The terms "outward", "outer" and derivatives thereof refer to the horizontal direction defined by a vector beginning at the center of the machine 10 and extending perpendicularly to the longitudinal dimension; conversely, the terms "inner", "inward" and derivatives thereof refer to the horizontal direction opposite the "outward" direction. Together, the "inward" and "outward" directions comprise the "transverse" dimension of the machine 10.

The frame 12 includes a generally longitudinally-extending base member 14 that rests on an underlying surface. A rear support member 16 is fixed to and rises from the rear end of the base member 14. An L-shaped front support member 18 is fixed to and rises from a central portion of the base member 14; the front support member 18 includes a vertical post 18*a* and a horizontal portion 18*b* that extends rearwardly from the vertical post 18*a*. A mechanism bracket 15 is fixed to the front end of the base member 14. A seat support 20 extends generally horizontally between the rear support member 16 and the forward support member 18.

Those skilled in this art will recognize that the frame 12 illustrated herein is exemplary and can take many configurations that would be suitable for use with the present invention. The frame 12 provides a strong, rigid foundation to which other components can be attached at desired locations, and other frame forms able to serve this purpose may also be acceptable for use with this invention.

The seat unit 22 comprises a backrest 24, a seat 26, and a seat frame 27. The seat frame 27 includes a sleeve 28 that is slidably attached to the seat support 20. The seat frame 27 also includes a backrest post 29 that extends upwardly from the rear end of the sleeve 28. The backrest 24 is fixed to the forward portion of the backrest post 29, and the seat 26 is fixed to the sleeve 28. The angle $\alpha$ formed between the seat 26 and the backrest 24 is typically between about 110 and 140 degrees. A pair of grasping handles (not shown herein) are attached to the lateral surfaces of the sleeve 28 and are provided for the user to grasp during exercise. Also, an adjustment pin 31 is mounted for vertical movement at the forward end of the sleeve; the adjustment pin 31 is received within one of several mounting apertures (not shown) in the upper surface of the seat support 20 to enable the seat unit 22 to be fixed in any one of a plurality of positions as the size of the exerciser dictates. Those skilled in this art will recognize that other seat unit configurations and other mechanisms for providing seat adjustability may also be suitable for use with the present invention.

The press mechanism 30 comprises two substantially identical front swing links 32, two substantially identical rear swing links 36, and a foot panel assembly 40. The front swing links 32 (only one of which is shown in FIG. 1) are pivotally interconnected laterally of the mechanism bracket 15 at a pivot 34. Each front swing link 32 is bipartite, with a lower portion 32*a* that extends generally upwardly from the pivot 34 and an upper portion 32*b* that extends rearwardly and upwardly from the lower portion 32*a*. Similarly, the rear swing links 36 (only one of which is visible in FIG. 1) are pivotally interconnected to and laterally of the mechanism bracket 15 at a pivot 38 that is located rearwardly from the pivot 34 (typically the distance between the pivots 34 and 38 is between about 5 and 15 inches). Each rear swing link 36 is also a bipartite member with a lower portion 36*a* that extends generally upwardly and an upper portion 36*b* that extends upwardly and rearwardly from the lower portion 36*a*. The angles $\beta 1$, $\beta 2$ formed between the lower portions 32*a*, 36*a* and their respective upper portions 32*b*, 36*b* are between about 120 and 155 degrees.

The foot panel assembly 40 includes a generally vertical, planar foot panel 42 that is adapted to receive the exerciser's feet, and further includes a connecting link 44 that is fixed to the forward surface of the foot panel 42 and extends forwardly therefrom. The connecting link 44 is pivotally attached to the top portion of the rear swing links 36 at a pivot 48 and to the top portion of the front swing links 32 at a pivot 46 located forwardly of the pivot 48 (the distance between the pivots 46 and 48 is typically about 4 to 16 inches, and the pivots 46, 48 are typically between about 24 and 36 inches from, respectively, the pivots 34, 38). It can be seen that the front swing links 32, the rear swing links 36, the portion of the mounting bracket 15 that spans the pivots 34 and 38, and the portion of the connecting link 44 that spans the pivots 46 and 48 form a four-bar linkage that controls the path and orientation of the foot panel 42 during exercise.

Those skilled in this art will appreciate that press mechanisms of other configurations may be employed with the present invention. For example, the shapes of the front and rear swing links 32, 36 may vary, or the positions of the pivots 34, 38, 46, 48 may vary. In some embodiments, a single swing link pivotally interconnected with the connecting link 44 and the mounting bracket 15 may be used; in such an instance, it is preferred that some other means of controlling the orientation of the foot panel 42 be included.

A drawing pulley mechanism 50 and an associated pulley train 60 are included in the leg press machine 10 as a unit that couples the resistance provided by the weight stack 80 to the press mechanism 30. The drawing pulley mechanism 50 includes a drawing link 52 that is pivotally interconnected at its forward end to the front swing links 32 at a pivot 54 located near the vertex of the lower portion 32*a* and the upper portion 32*b* of the front swing links 32. A control link 56 is attached at its upper end to the connecting link 44 at a pivot 58 located rearwardly of the pivot 48 and at its lower end to an intermediate portion of the drawing link 52 at a pivot 59. In the retracted position of the leg press machine illustrated in FIG. 1, the drawing pulley link 52 extends downwardly and rearwardly from the pivot 54 at an angle of approximately 30 to 45 degrees relative to the underlying surface, and the control link 56 extends downwardly and forwardly from the pivot 58 to the pivot 59 to form an angle of between about 75 and 85 degrees with the drawing link 52, such that the pivots 58, 59 and 54 form an angle $\delta 1$ of between about 75 and 85 degrees with each other when the machine 10 is in the retracted position of FIG. 1.

Figure 4:
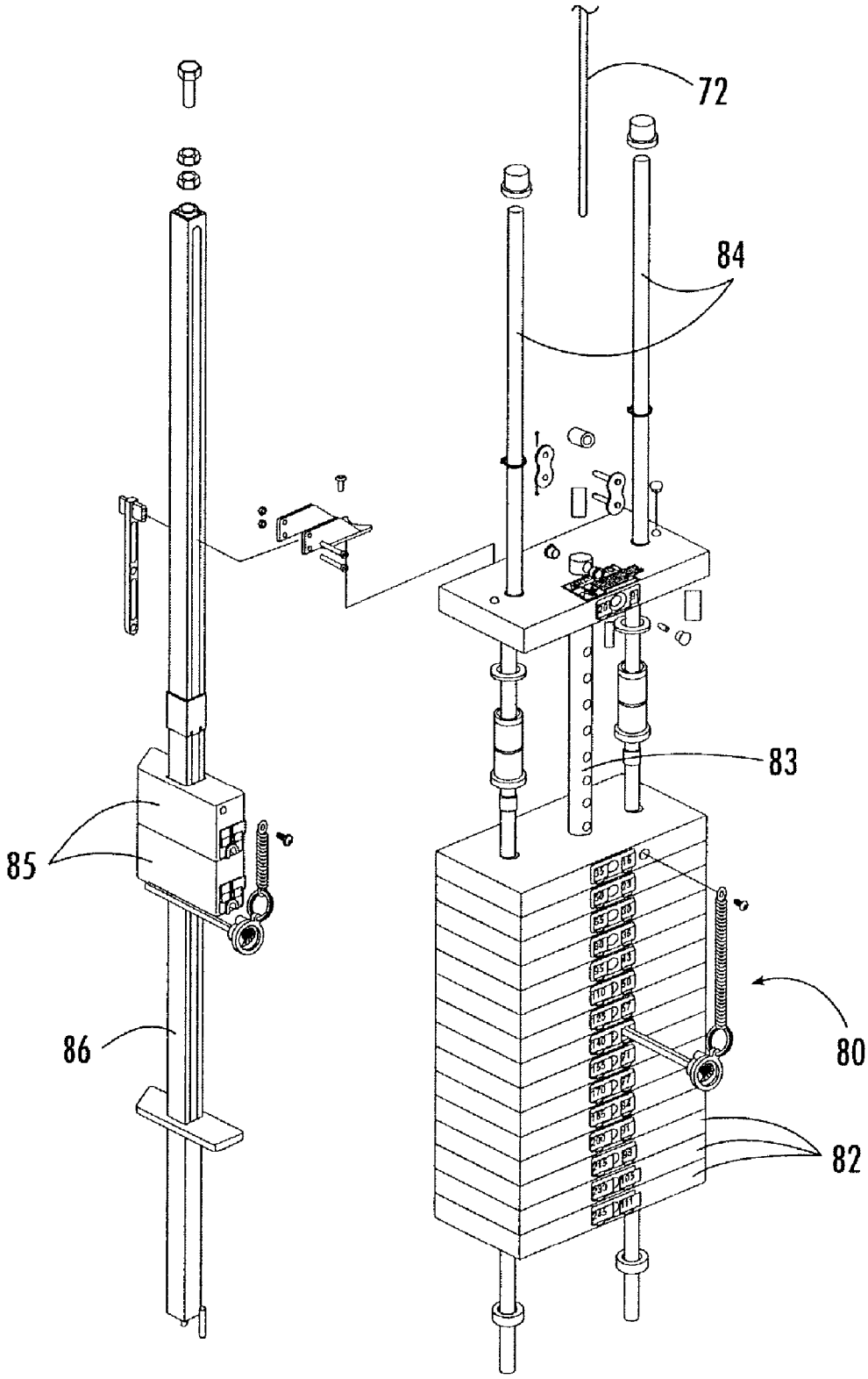
FIG. 4 is an enlarged partial exploded perspective view of the weight stack of the leg press machine of FIG. 1.

The pulley train 60 includes a pair of upper and lower forward pulleys 64, 66 mounted to the post 18*a* of the forward support member 18, a drawing pulley 62 attached to the rearward end of the drawing link 52, three transitional pulleys 71*a*, 71*b*, 71*c* mounted to the base 14, two pulleys 70, 70*b* attached to the rear support member 16, and an upper transitional pulley 74*a* attached to the frame above the weight stack 80 (see FIGS. 1 and 4). A cable 72 is fixed to an upper portion of the rear support 16 and is threaded, in sequence, behind the pulleys 70*b*, 70, over the lower forward pulley 66, around the drawing pulley 62, over the upper forward pulley 64, below the transitional pulleys 71*a*, 71*c*, around the transitional pulley 71*b*, and over the upper transitional pulley 74*a* before traveling to the weight stack 80 in the manner described below.

Referring now to FIG. 4, the weight stack 80 includes a set of weights 82 arranged in a vertical stack. A lifting rod 83 extends vertically through apertures in the weights 82 and is configured to receive a pin inserted between individual weights 82 that enables the user to select the number of weights to be used in the exercise. The weight stack 80 also includes guide rods 84 that extend vertically through the weights 82 to guide the weights 82 along a vertical path during exercise. Weight stacks of this variety are well known to those skilled in this art and need not be described in detailed herein. In addition, the leg press machine 10 may optionally include a set of auxiliary weights 85 that slide along a vertical guide rod 86 and that can be temporarily connected with the selected weights to provide incremental weight during exercise. Again, auxiliary weight systems of this type are well known to those skilled in this art and need not be described in detail herein. An exemplary machine having such a weight stack is a leg extension machine available from Nautilus HPS, Inc. (Independence, Va.) under the trade name NITRO™.

Those skilled in this art will recognize that, although a weight stack is the preferred structure for providing resistance to the exerciser, other resistance-imparting structures, such as friction-imparting devices, variable viscosity devices, air drag-based resistance devices, and the like, may also be employed with a leg press machine of the present invention. Exemplary resistance devices include those illustrated in U.S. Pat. Nos. 5,810,096, 4,708,338; 4,720,093; 5,033,733; 4,542,897; 4,298,893; 4,805,901; 4,790,528; 4,786,049; 5,031,900; 4,775,145; 4,589,656; and 4,659,074, the disclosures of each of which are hereby incorporated herein by reference in their entireties.

Referring back to FIG. 1, in operation, the exerciser adjusts the position of the seat unit 22 by lifting the adjustment pin 31, sliding the seat unit 22 to a desired position along the seat support 20 (specifically, in the movement the sleeve 28 slides relative to the seat support 20), and replacing the adjustment pin 31 in one of the apertures in the seat support 20. Preferably, the seat unit 22 is positioned such that, when the exerciser is seated in the seat unit 22 and his feet are placed on the foot panel 42, the exerciser's thighs and lower legs form approximately a 70 degree angle, and the lower legs are substantially normal to the foot panel 42. The exerciser then selects a desired resistance by positioning a pin between two weights 82 and into the lifting rod 83.

Referring again to FIG. 1, to begin exercising, the exerciser sits in the seat unit 22, places his feet on the foot panel 42, and pushes the foot panel 42 forwardly with his feet (most of the pushing force is transferred to the foot panel 42 through the heels). In this retracted position, the foot panel 42 forms and angle $\gamma 1$ relative to the seat 26, the angle $\gamma 1$ being between about 110 and 120 degrees. The force applied by the exerciser causes the foot panel 42 to move forwardly, and also to rotate such that its angle $\gamma$ decreases with increasing distance from the seal 26. This movement is controlled by the rotation of the front and rear swing links 32, 36 about the pivots 34, 38 (this rotation is clockwise from the vantage point of FIG. 1) and the forward translation and rotation of the connecting link 44 (this rotation is counterclockwise from the vantage point of FIG. 1).

Figure 2:
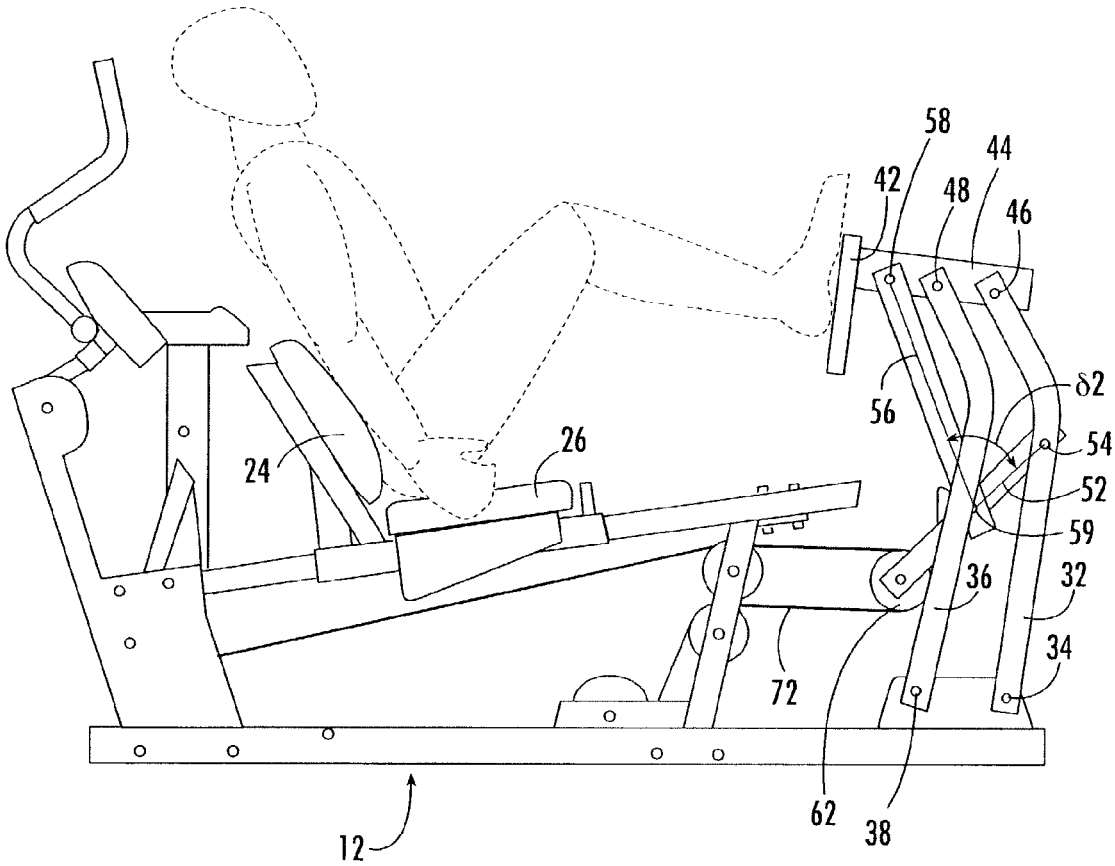
FIG. 2 is a side view of the leg press machine of FIG. 1 with the foot panel in an intermediate position.
Figure 3:
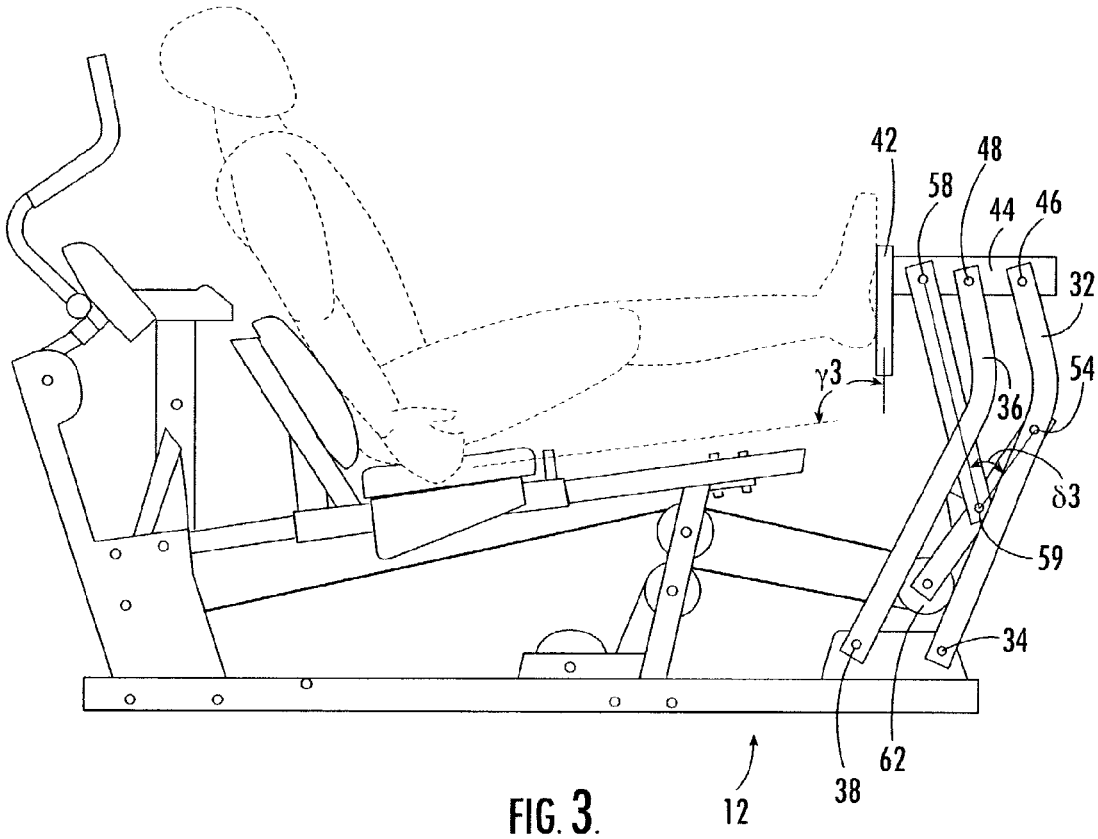
FIG. 3 is a side view of the leg press machine of FIG. 1 with the foot panel in the fully extended position.

As the exerciser continues to push forwardly on the foot panel 42 with his feet, the foot panel 42 continues to travel away from the seat 26 (FIG. 2) until the exerciser's legs are fully extended (FIG. 3). This movement is resisted by the selected weights 82, which are coupled to the press mechanism 30 through the drawing pulley mechanism 50 and the pulley train 60. More specifically, as the front and rear swing arms 32, 36 rotate about the pivots 34, 38 in response to the exerciser's effort, the forward end of the drawing link 52 also moves forwardly, and the rear end of the drawing link 52 moves forwardly and downwardly (this movement is controlled by the control link 56). Consequently, the drawing pulley 62 also moves forwardly and downwardly. This action draws the upper portion of the cable 72 (i.e., that portion that passes over the pulley 64) forwardly, which in turn causes the selected weights 82 to rise from the weight stack 80.

The exercise movement is completed when the exerciser's legs are fully extended (FIG. 3). In the extended position, the foot panel 42 has rotated to an angle $\gamma 2$, which is between about 85 and 100 degrees, and has traveled a distance of between about 16 and 24 inches relative to the seat 26. The rotation of the foot panel 42 can enable the exerciser to maintain an angle between the foot panel 42 and his lower legs of approximately ninety degrees, as is desirable.

The movement of the drawing pulley 62 during the exercise stroke is notable, as such movement is related to the resistance curve for the leg press machine 10. As described above, typically a leg press machine strives to provide significantly higher resistance toward the end of the exercise stroke in order to increase the efficiency of exercise. Because the magnitude of the selected weights 82 does not change during the movement, changes in resistance are achieved in other ways. In the illustrated leg press machine 10, one structural characteristic thereof that increases the resistance toward the end of the exercise stroke is the fact that, as the foot panel 42 rotates during the stroke, it also moves downwardly slightly. As a result, the exerciser has a somewhat shorter lever arm to use to move the resisted swing links 32, 36, thereby requiring more force from the exerciser to overcome the same weight. In the illustrated embodiment, the foot panel 42 drops between about 6 and 8 inches (or about 20 to 25 percent of the total length of the lever arm formed by the front swing link 32), with the result that the resistance rises about 20–25 percent over the exercise stroke due to this feature.

In addition, resistance is increased toward the end of the exercise stroke due to the movement of the drawing pulley 52. It is a fundamental law of mechanics that $$\text{Work}=\text{Force}\times\text{Distance}$$

Figure 5:
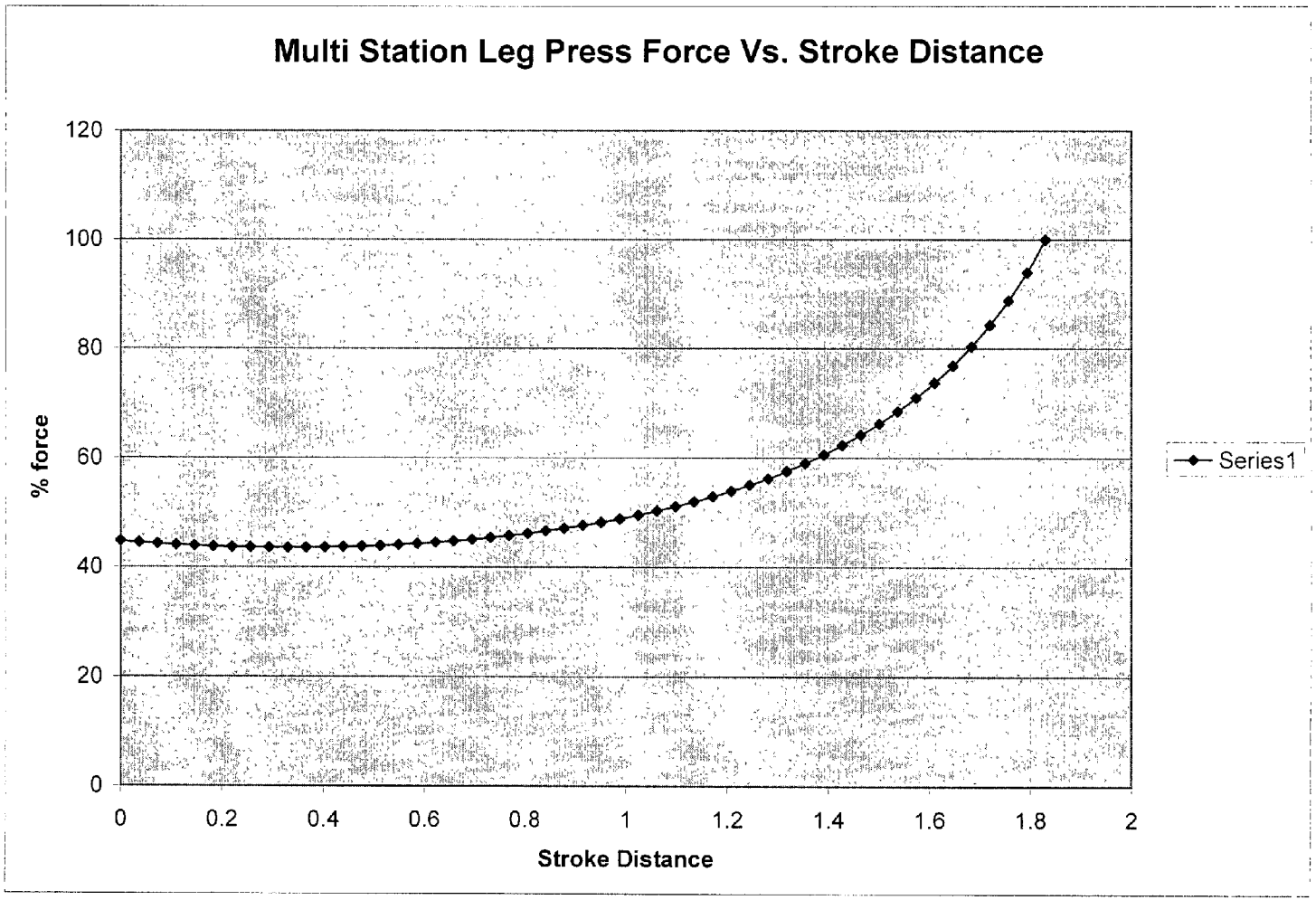
FIG. 5 is a graph plotting resistance as a function of stroke position for the exercise machine of FIG. 1.

Therefore, if a force is constant, but the distance over which the force is applied is increased, there is a proportionate increase in work. In the exercise context, if an exercise machine requires that, during an exercise stroke, a weight is moved over a greater distance during a first portion of an exercise stroke than during a second portion, the amount of work required to perform the first portion of the stroke is higher (and, therefore, the exercise is more intense) than that of the second portion. The drawing pulley mechanism 50 is configured such that the drawing pulley 52 moves away from the stationary upper and lower forward pulleys 64, 66 much more rapidly during the latter portions of the exercise stroke than during the initial stages, particularly in proportion to the amount of movement of the foot panel 42 (this can be seen in the change of the angle δ between the pivots 58, 59, and 54, which changes from a value of between about 75 and 85 degrees for δ1 in FIG. 1 to a value of between about 55 and 65 degrees for δ2 in FIG. 2 and to a value of between about 20 and 30 degrees for δ3 in FIG. 3). Viewed somewhat differently, during the movement of the foot panel 42 from the resting position of FIG. 1 to the intermediate position of FIG. 2, the drawing pulley 62 moves approximately 11 inches, while the heel of the exerciser moves approximately 8 inches (which results in a pulley travel/heel travel ratio of about 0.73; between 0.6 and 0.8 is preferred). In contrast, during the movement of the foot panel 42 from the intermediate position of FIG. 2 to the fully extended position of FIG. 3, the drawing pulley 62 moves approximately 11.2 inches, while the heel of the exerciser moves approximately II inches (giving a pulley travel/heel travel ratio of about 1.02; a ratio of between about 1.0 and 1.3 is preferred). This much higher value for the pulley travel/heel travel ratio is essentially proportional to the increase in resistance experienced by the exerciser from the first to the second portion of the exercise stroke. Similar comparisons can be made for any segment along the exercise stroke. The entire resistance curve for the embodiment illustrated herein is shown in FIG. 5, and illustrates that, particularly for the final 40 percent of the stroke, resistance increases significantly. This portion of the stroke correlates generally to the portion of the stroke when the movement of the drawing pulley 62 is generally forward (ie., away from the seat unit 22).

Once the exerciser has completed the exercise stroke, he allows the foot panel 42 to return to the retracted position of FIG. 1, at which time the exercise movement is typically repeated. During the return stroke, the components of the press mechanism 30, the drawing pulley mechanism 50, the pulley train 60, and the weight stack 80 reverse the movements they followed as they moved to the fully extended position.

Those skilled in this art will appreciate that, although the leg press machine 10 is illustrated as a "stand-alone" machine, it can be incorporated as a station into a multi-station exercise machine, such as that available from Nautilus HPS, Inc. under the trade name PERSONAL CIRCUIT. In such a machine, the leg press station may have its own weight stack or, more typically, may share its weight stack with one or more stations. The ordinarily skilled artisan will understand the modifications to the leg press machine of the present invention that may be needed in order that the leg press station be utilized within a multi-station exercise machine.

The foregoing demonstrates that leg press machines of the present invention can provide leg press motion with desirable characteristics, such as a foot panel that enables a preferred lower leg/foot panel and a resistance profile that increases significantly at the end of the exercise stroke, and can provide these characteristics with a relatively easily manufactured mechanism that does not require cams or the like.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A leg press exercise machine, comprising:

a frame;

a seat unit attached to the frame;

a press mechanism pivotally attached to the frame, the press mechanism including a foot panel configured to receive an exerciser's feet during exercise and a front swing link pivotally interconnected with the frame, the press mechanism being configured such that the foot panel is movable along a generally longitudinal stroke path between a retracted position and a fully extended position, wherein the press mechanism further comprises a rear swing link pivotally interconnected with the frame and a connecting link fixed to and extending forwardly from the foot panel and pivotally interconnected with the rear swing link at a first pivot and with the front swing link at a second pivot;

a resistance-imparting unit operatively connected with the press mechanism to provide resistance to the foot panel as it moves from the retracted position to the fully extended position; and a resistance coupling mechanism attached to the press mechanism and to the resistance-imparting unit, the resistance coupling mechanism including:

a drawing link pivotally interconnected with the front swing link; and a control link pivotally interconnected with the drawing link and with the connecting link at a third pivot, and further is attached to the resistance-imparting unit.

2. The leg press machine defined in claim 1, wherein the third pivot is positioned rearwardly of the first and second pivots.

3. The leg press machine defined in claim 1, wherein the resistance-imparting unit comprises a cable, and wherein the resistance coupling mechanism further comprises a rotary member attached to the drawing link that engages the cable.

4. The leg press mechanism defined in claim 3, wherein the cable is fixed at one end to the frame.

5. The leg press mechanism defined in claim 4, wherein the resistance-imparting mechanism further comprises a weight stack.

6. The leg press mechanism defined in claim 1, wherein the rear and front swing links are pivotally interconnected with the frame at fourth and fifth pivots, respectively, and wherein the first and fourth pivots define a first distance, and the second and fifth pivots define a second distance that is less than the first distance.

7. The leg press mechanism defined in claim 1, wherein the drawing link is pivotally interconnected with the control link at a sixth pivot and with the front swing link at a seventh pivot, and wherein an angle defined by the third, sixth and seventh pivot decreases as the leg panel moves to the extended position.

8. A leg press exercise machine, comprising:

a frame;

a seat unit attached to the frame;

a press mechanism pivotally attached to the frame, the press mechanism including a foot panel configured to receive an exerciser's feet during exercise and a front swing link pivotally interconnected with the frame, the press mechanism being configured such that the foot panel is movable along a generally longitudinal stroke path between a retracted position and a fully extended position, wherein the press mechanism further comprises a rear swing link pivotally interconnected with the frame; and a connecting link fixed to and extending forwardly from the foot panel and pivotally interconnected with the rear swing link at a first pivot and with the front swing link at a second pivot;

a resistance-imparting unit operatively connected with the press mechanism to provide resistance to the foot panel as it moves from the refracted position to the fully extended position; and a resistance coupling mechanism attached to the press mechanism and to the resistance-imparting unit, the resistance coupling mechanism including:

a drawing link pivotally interconnected with the front swing link; and a control link pivotally interconnected with the drawing link and with the connecting link at a third pivot, and further is attached at one end portion to the resistance-imparting unit;

wherein the press mechanism and the resistance coupling mechanism are configured such that, during a first portion of the exercise stroke, the foot panel travels a first distance that is greater than a second distance traveled by the control link end portion, and during a second portion of the exercise stroke, the foot panel travels a third distance that is less than a fourth distance traveled by the control link end portion.

9. The leg press mechanism defined in claim 8, wherein the ratio between the first and second distances is between about 0.6 and 0.8, and the ratio between the third and distances is between about 1.0 and 1.3.

10. The leg press mechanism defined in claim 8, wherein the control link end portion includes a rotary member, and the resistance-imparting unit includes a cable that engages the rotary member.

11. The leg press machine defined in claim 8, wherein the third pivot is positioned rearwardly of the first and second pivots.

12. The leg press mechanism defined in claim 10, wherein the cable is fixed at one end to the frame.

13. The leg press mechanism defined in claim 12, wherein the resistance-imparting mechanism further comprises a weight stack.

14. The leg press mechanism defined in claim 10, wherein the rear and front swing links are pivotally interconnected with the frame at fourth and fifth pivots, respectively, and wherein the first and fourth pivots define a first distance, and the second and fifth pivots define a second distance that is less than the first distance.

15. The leg press mechanism defined in claim 8, wherein the drawing link is pivotally interconnected with the control link at a sixth pivot and with the front swing link at a seventh pivot, and wherein an angle defined by the third, sixth and seventh pivot decreases as the leg panel moves to the extended position.

16. A leg press exercise machine, comprising:

a frame;

a seat unit attached to the frame;

a press mechanism pivotally attached to the frame, the press mechanism including:

a foot panel configured to receive an exerciser's feet during exercise;

a front swing link pivotally interconnected with the frame;

a rear swing link pivotally interconnected with the frame; and a connecting lint fixed to and extending forwardly from the foot panel and pivotally interconnected with the rear swing link at a first pivot and with the front swing link at a second pivot positioned forwardly of the first pivot;

the press mechanism being configured such that the foot panel is movable along a generally longitudinal stroke path between a retracted position and a fully extended position;

a resistance-imparting unit operatively connected with the press mechanism to provide resistance to the foot panel as it moves from the retracted position to the fully extended position, the resistance-imparting unit including a cable; and a resistance coupling mechanism attached to the press mechanism and to the resistance-imparting unit, the resistance coupling mechanism including:

a drawing link pivotally interconnected with the front swing link; and a control link pivotally interconnected with the drawing link and with the connecting link at a third pivot positioned rearwardly of the second pivot, the drawing link being further coupled to the resistance-imparting unit.

17. The leg press mechanism defined in claim 16, wherein the resistance-imparting unit includes a weight stack.

18. The leg press mechanism defined in claim 16, wherein the resistance-coupling mechanism includes a rotary member attached to the control link.

* * * * *

UNITED STATES PATENT AND TRADEMARK OFFICE

CERTIFICATE OF CORRECTION

PATENT NO. : 7,004,890 B2
APPLICATION NO. : 10/192330
DATED : February 28, 2006
INVENTOR(S) : Webb et al.

It is certified that error appears in the above-identified patent and that said Letters Patent is hereby corrected as shown below:

Column 9,
Line 31 should read -- as it moves from the retracted position to the fully --

Signed and Sealed this

Eighth Day of May, 2007

JON W. DUDAS
*Director of the United States Patent and Trademark Office*